United States Patent [19]

Kropa

[11] 4,106,708

[45] Aug. 15, 1978

[54] GRANULATOR AND KNIFE CONSTRUCTION THEREFOR

[75] Inventor: Gomer E. Kropa, North Reading, Mass.

[73] Assignee: Leesona Corporation, Warwick, R.I.

[21] Appl. No.: 786,669

[22] Filed: Apr. 11, 1977

[51] Int. Cl.[2] ..... B02C 13/02; B02C 18/18

[52] U.S. Cl. ..... 241/222; 241/242; 241/294

[58] Field of Search ..... 241/73, 221, 222, 224, 241/242, 294

[56] References Cited

U.S. PATENT DOCUMENTS

| | | | |
|---|---|---|---|
| 2,830,770 | 4/1958 | DeLuca | 241/73 |
| 3,270,968 | 9/1966 | Hess et al. | 241/224 X |
| 3,301,291 | 1/1967 | Hughes | 241/222 X |
| 3,378,210 | 4/1968 | Bambach | 241/294 X |
| 4,000,860 | 1/1977 | Gotham | 241/73 X |

*Primary Examiner*—Roy Lake

*Assistant Examiner*—Howard N. Goldberg

*Attorney, Agent, or Firm*—Robert J. Doherty

[57] ABSTRACT

The present disclosure relates to a knife construction adapted for positioning within cut out seat portions of a rotor. The base of the knife is provided with a downwardly extending relatively narrow leg at the front face thereof which is adapted to engage base portions of the rotor seat so as to form an area of high sealing contact between the engaging surfaces and thus prevent liquified, i.e. fluid acting under high pressures, plastic material from flowing underneath the knife and thus undesirably altering its position vis-a-vis the rotor. A further embodiment includes an elevated or stepped pad forming the seat for receipt of the knife, the stepped or elevated front face of the pad forming a continuation of the blade face of the knife so as to distribute the forces imparted by such liquified plastic material over a larger combined area and thus reduce the force thereof upon the knife/seat interface.

11 Claims, 3 Drawing Figures

PRIOR ART

GRANULATOR AND KNIFE CONSTRUCTION THEREFOR

BACKGROUND AND SUMMARY OF THE INVENTION

The present invention is directed to granulating machines for the size reduction of plastic material and particularly to a knife construction therefor. Devices of this nature often by the combined action of rotor weight, speed etc., impart large forces upon relatively small segments of plastic material in contact with the blade, rotor and housing portions of such granulators.

In some cases these forces are large enough to liquify portions of the thermoplastic plastic material being worked. This leads to the forcing of this liquified plastic into the interface between the knife itself and the knife seat area of the rotor, which undesirably leads to a buildup of solidified plastic underneath the knife structure resulting in its improper positioning vis-a-vis the rotor and other granulator portions. This tendency has been found especially true in knives having blade portions of the hook-shaped or similar configuration which present an undercut or pocket for receipt of curls, chips and the like of plastic material cut from a larger piece. The forward interface or junction between the blade and the rotor, with hook-shaped blades is located within such undercut or pocket area and particularly accessible to such liquified plastic.

It is accordingly a primary object of the present invention to provide a knife construction having a configuration so as to prevent plastic material liquified by the granulated cutting action to enter between the interface of the knife and its rotor seat.

A further object of the present invention is the provision of a granulator knife construction which applies an unusually high degree of pressure at the forward parting line between the knife and the rotor seat upon which it is adapted to rest so as to seal such cooperating surfaces and thus prevent plastic liquified by the granulating action to enter into such interface areas.

Still another object of the present invention is the provision of a rotor construction including a seat adapted for the receipt of a granulating knife which presents an enlarged forward surface so as to distribute force applied by plastic liquified by the granulating action over a larger than normal surface so as to reduce the force or tendency for such to enter between the knife and rotor seat interface.

A still further object of the present invention is the provision of a combination rotor knife construction in which the rotor includes an upstanding pad for receipt of a hook-shaped blade having an undercut segment wherein the stepped portion of the pad forms a continuation of such blade segment.

A further object of the invention is the provision of a modified knife construction which can be utilized without modifying existing rotors so as to provide a higher and accordingly effective sealing relationship between the front face of the blade and the rotor seat.

These and other objects of the invention as will become apparent from the foregoing description are accomplished by the provision of a granulator knife so constructed for operative association with a granulator rotor having a plurality of cut out portions in the outer periphery thereof to form blade receiving seats. The knife includes a base portion adapted to engage such seats, which base portion includes a relatively narrow downwardly extending foot disposed at the forward edge thereof and forming a continuation of an undercut blade segment adapted to receive plastic material and means in the top surface of the knife for receiving a plurality of bolts so as to force said foot into high pressure sealing relationship engagement with the rotor seat, thus effectively preventing the flow of liquefied plastic material between the knife/rotor seat interface. Additionally the rotor seat may be provided with an upwardly stepped configuration wherein the front face in turn forms a continuation of the above described plastic receiving blade undercut or pocket and accordingly serves to increase the area in which the force applied by such liquid plastic is distributed.

Other objects and features of the invention will become more apparent by reference to the following drawing and detailed description of the invention.

DESCRIPTION OF THE DRAWING

In the drawing which illustrates the best mode presently contemplated for carrying out the present invention.

DESCRIPTION OF THE INVENTION

Figure 2:
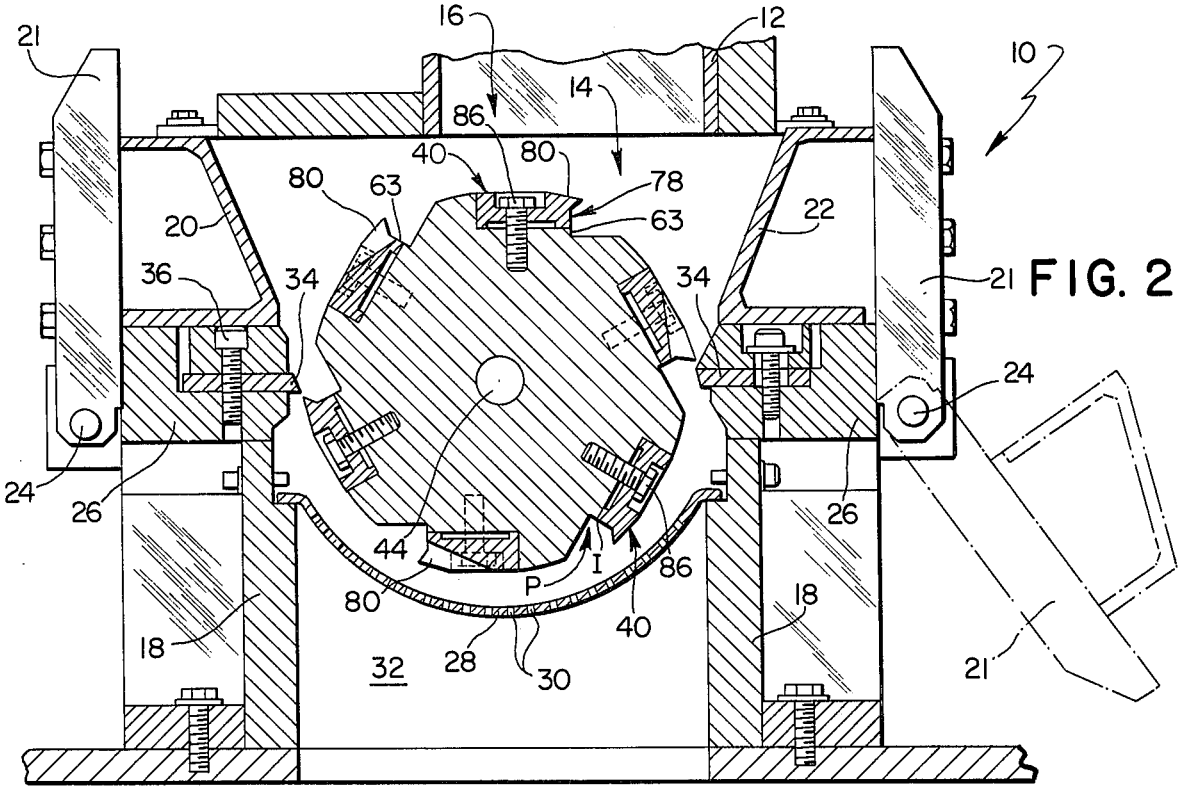
FIG. 2 is a side cross-sectional view of a granulator embodying the features of the present invention.

Turning now to FIG. 2, there is shown a granulator construction identified by the reference numeral 10. Granulator 10 includes the usual hopper 12 into which plastic resin material such as relatively large purgings and the like are fed to the cutting chamber 14 via the opening 16. The chamber 14 has a relatively heavy base or frame 18 which forms the lower region of the cutting chamber 14. The cutting chamber 14 is also defined by opposed walls 20 and 22 of relatively heavy metal fabrications in the form of doors 21 pivoted about shafts 24 so that the direct access to the cutting chamber 14 is available both on the upstroke and downstroke sides of the rotor. The lower end of cutting chamber 14, further defined by a screen 28 which has a plurality of screen holes or openings 30 of a predetermined size therethrough, the size being determined by the size of particulate which will be permitted to be discharged from the cutting chamber 14. The particulate granulated within cutting chamber 14 is permitted to move outward from the cutting chamber through holes 30 and be discharged downwardly through a confined throat 32.

Within cutting chamber 14 there is also mounted a pair of oppositely disposed bed knives 34 which are rigidly fixed in lower wall segments 26 by suitable bolt means 36. The wall segments 26 in turn serve to support the walls 20 and 22 respectively as shown. The forward end of each bed knife is arranged in close proximity to the cutting circle and a plurality of rotor knives 40 are secured on the outer periphery of a rotor 42. Rotor 42 is mounted for rotation about a longitudinally disposed axis 44. Rotor 42 is suitably driven by means such as an electric motor (not shown).

It will be understood that material delivered into cutting chamber 14 through hopper 12 encounters the cooperative cutting action of bed knives 34 and rotor knives 40, the material passing into the lower portion of cutting chamber 14 i.e., that portion of the cutting chamber lying below the opposite bed knives 34. When the material is reduced in size to a degree sufficient to pass out through the openings 30 in screen 28 it falls through throat 32 and received in by suitable conveyor means (not shown).

Figure 1:
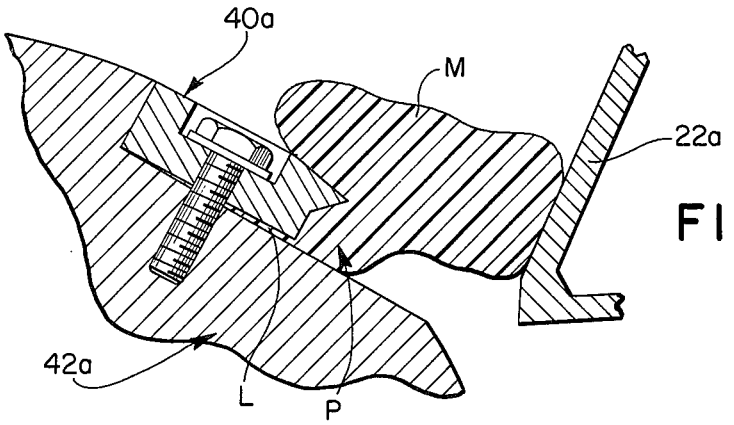
FIG. 1 is a partial cross-sectional view of a rotor knife mounted in accordance with the prior art wherein portions of plastic material liquified under high pressure are shown entering the knife/rotor seat interface.

The prior art depiction in FIG. 1 of the drawing shows what can happen under certain circumstances when the high frictional forces of the knife 40*a*, the rotor 42*a* and granulator housing portions such as the wall 22*a* liquify a portion L of the material being worked on. This liquification is particularly apt to happen when the cutting surfaces exhibit a generally hook-shaped configuration and define a pocket P within which a portion of the material M is confined. This liquified material L under the high forces previously referred to, tends to enter the interface between the knife 40*a* and the rotor 42*a* and thus undesirably raises the front portion of the knife 40*a* upwardly and in some cases out of the cutting circle. Such above described action can either interfere with the desired cutting action or cause a rotor knife 40*a* to physically contact one or more of the bed knives 34.

Figure 3:
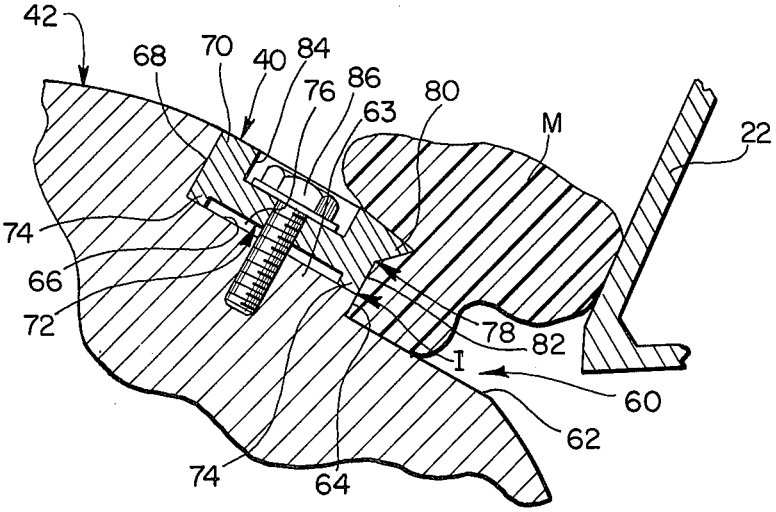
FIG. 3 is an enlarged sectional view of FIG. 2 and shows in particular the configuration of both the knife construction and rotor seat construction of the present invention.

In order to prevent such undesirable action from occurring, the knife of the present invention is so constructed so as to impart a greater amount of force at the knife/rotor interface or parting line I so as to seal off such area from the inflow of liquified plastic material L and to additionally create a larger area over which the liquified material L acts so as to reduce the amount of driving force available to attempt the forcing of the material beneath the forward edge of the knife 40. The configuration of each of the knives 40 is best shown by simultaneous reference to FIGS. 2 and 3 of the drawing wherein the rotor is provided with a plurality of partial cutouts 60 each extending along chords thereof and spaced about the periphery thereof. The cut outs 60 each form a surface 62 along a first chord and an upstanding or stepped platform or pad 63 having a stepped face 64 and a base surface 66 and terminating in an upstanding shoulder 68 at the inner terminus thereof for abutting receipt of a rotor knife.

Each such knife includes a continuous heel portion 70 adapted as above explained for abutting receipt with the shoulder 68 and a base portion 72 in turn including a pair of relatively narrow downwardly extending feet 74 positioned respectively at the inner and outer faces thereof and separated by a centrally positioned inset or cut out portion 76. A generally hook-shaped blade face portion 78 is disposed opposite to the heel 70 and includes a plurality of laterally spaced blades 80 which are integral with the remaining knife portions and an undercut supporting segment 82 disposed therebeneath and cooperating to form said blade face surface 78. It should also be pointed out that the forwardly disposed leg 74 also forms a continuation of such blade face 78 and that the shoulder or front face 64 of the pad 63 is aligned therewith so as to increase the height of the pocket in which plastic material separated from a larger mass end thereof may be received.

The upper surface is further provided with a series of openings or counter bores 84 each adapted to receive a bolt 86 which in turn passes through remaining portions of the knife 40 including the cut out portion 76 thereof and projects into threaded engagement with the rotor 42 and thus upon tightening of such bolts 86 serves to force the knife 40, or more accurately the feet 74 thereof, into sealing engagement with the base surface 66 of the rotor pad 63. Because of the relatively narrow configuration of the foot 74 at the forward portion of the blade, such reduces the area in which the force applied by the bolts 86 may be transmitted and accordingly increases the pressure in that area of mutual engagement that is the interface or parting line I between the knife and rotor. In this manner, then, the bolt forces normally transmitted to hold the knife in place on the rotor may be localized in the above described area beneath the feet 74 so as to effectively increase the contact pressure in such area and prevent any liquified plastic material from entering the parting line therebetween and thus entering beneath the knife 40. In addition, the extent of the pad 63 and the orientation of its front face 64 is such that the front face 64 is aligned as a continuation of the blade front face portion 78 and thus presents larger blade area for distribution of those forces attempting to force liquified plastic material within the interface I of the knife and rotor. This elevated pad inclusion as above described further contributes to reducing the driving force or pressure available to force liquefied plastic into the interface I.

It should be understood that variations, modifications and special adaptations of the embodiments of the present invention above disclosed may be utilized without departing from the scope of the present invention as set forth in the following claims; for example, a knife construction including feet 74 may be utilized with prior art rotor construction not including the elevated pad 63 and that similarly the elevated pad construction which may be similarly utilized alone and not in conjunction with the pressure focusing or localizing feet 74, but that the contribution of such mechanisms, either alone or in combination provide both novel granulator and cooperating knife constructions which accomplish the objects of the present invention in a straightforward relatively inexpensive manner.

What is claimed is:

1. A knife construction adapted for operative positioning with respect to a granular-to-rotor having a plurality of cut out portions laterally extending along spaced peripheral chords thereof to form continuous longitudinally extending seats each having a flat base portion along said chord and an upstanding shoulder at an inner terminus thereof for abutting receipt of said knife, said knife comprising an upstanding heel portion adapted to engage said seat shoulder, a base portion adapted to engage said seat base, a top surface opposite said base portion, and a generally hook-shaped blade face portion opposite said heel portion, said face portion having an outwardly extending cutting blade disposed above an undercut supporting segment thus forming a pocket for receipt of plastic material cut by said blade from a larger body of thermoplastic plastic material, said base portion including at least one relatively narrow downwardly directed, longitudinally extending foot portion adapted to engage the forward edge of said seat base, and means disposed through said top surface for receiving holding means to force said foot portion into high pressure sealing relationship engagement with said seat base, said base portion including an upwardly rearwardly extending cut out portion disposed adjacent said foot portion so as to concentrate such force at said foot portion.

2. The knife construction of claim 1, said base portion having spaced foot portions and said upwardly extending generally centrally disposed cut out being positioned between said feet.

3. The knife construction of claim 2, said feet disposed at the forward and rear extremities of said base portion and said holding means adapted to extend through said cut out.

4. The knife construction of claim 1, said seats being upwardly stepped wherein the front face of each said step forms a continuation of said blade face so as to increase the extent thereof and thus distribute the force of plastic material engaged thereagainst over such combined area.

5. The knife construction of claim 1, said blade face having a plurality of integral laterally spaced blades.

6. The knife construction of claim 5, including a plurality of depressions provided in the top surface of said knife positioned behind said blades thereof for receipt of bolt means to secure said knife to the rotor.

7. A granulator for size reduction of plastic material comprising a chamber, a generally cylindrical rotor mounted within said chamber for rotation about an axis, means for driving said rotor about said axis, cutting means comprising a plurality of knives affixed on said rotor, at least one bed knife situated for cooperative cutting relationship with said rotor knives as said rotor is driven to effect size reduction of material fed into said chamber, said rotor having a plurality of cut out portions each extending along a chord and spaced about the periphery thereof, each of said cut out portions longitudinally extending continuously along a major portion of the rotor axis and forming a seat having a flat base portion along said chord and an upstanding shoulder portion at the inner lateral terminus thereof for abutting receipt of a rotor knife, each such knife having an upstanding heel portion adapted to engage said seat shoulder, a base portion adapted to engage said seat base, a top surface opposite said base portion, and a generally hook-shaped blade face portion opposite said heel portion, said face portion having an outwardly extending cutting blade disposed above an undercut supporting segment thus forming a pocket for receipt of plastic material cut by said blade from a larger body of thermoplastic plastic material, said base portion including at least one relatively narrow downwardly directed, longitudinally extending foot portion disposed at the forward edge thereof and forming a continuation of said undercut supporting segment, and means disposed through said top surface for receiving a plurality of bolts so as to force said foot portion into high pressure sealing relationship engagement with said seat base, said base portion including an upwardly rearwardly extending cut out portion disposed adjacent said foot portion so as to concentrate such force at said foot portion.

8. The granulator construction of claim 7, each of said rotor cut out portions disposed along first and second chords thereof so as to form an upwardly stepped seat pad having an upwardly extending front face, said knife disposed on said pad so that the front face thereof forms a continuation of said blade face so as to distribute the force of plastic material engaged thereagainst over such combined area.

9. The granulator construction of claim 8, said base portion having spaced foot portions and said upwardly extending generally centrally disposed cut out being positioned between said feet.

10. The granulator construction of claim 9, said feet disposed at the forward and rear extremities of said base portion and said bolts adapted to extend through said cut out.

11. In a granulator construction for the size reduction of plastic material having a chamber, a rotor mounted in said chamber, cutting knives mounted on said rotor and a bed knife mounted in said chamber for cooperation with said cutting knives, a generally cylindrical rotor mounted for rotation within said chamber about a cutting axis, said rotor having a plurality of cut out portions each extending along sets of first and second generally parallel chords spaced about the periphery thereof, said second chords disposed radially outward with respect to said first chords in each set thereof, each of said rotor cut out portions disposed along said first and second chords thereof so as to form an upwardly stepped pad having an upwardly extending front face, said pad forming a seat having a flat base portion along said second chord and an upstanding shoulder portion at the inner lateral terminus thereof for abutting receipt of a rotor knife, each such knife having an upstanding heel portion adapted to engage said seat shoulder, a base portion adapted to engage said seat base, a top surface opposite said base portion, and a generally hook-shaped blade face portion opposite said heel portion, said blade face portion having an outwardly extending cutting blade disposed above an undercut supporting segment and said blade mounted on said seat wherein said undercut supporting segment thereof is aligned with and forms a continuation of said pad face wherein said pad face and said blade face cooperatively form a continuous pocket for receipt of plastic material cut by said blade from a larger body of thermoplastic plastic material, said blade base portion including at least one relatively narrow downwardly directed, longitudinally extending foot portion disposed at the forward edge thereof and forming a continuation of said undercut supporting segment, and means disposed through said top surface for receiving a plurality of bolts so as to force said foot portion into high pressure sealing relationship engagement with said seat base, said base portion including an upwardly rearwardly extending cut out portion disposed adjacent said foot portion so as to concentrate such force at said foot portion.

* * * * *